US009086194B2

(12) United States Patent
Eibner et al.

(10) Patent No.: US 9,086,194 B2
(45) Date of Patent: Jul. 21, 2015

(54) CLIP LIGHT

(75) Inventors: William A. Eibner, Saint Paul, MN (US); Joseph A. Hoffman, Minneapolis, MN (US); Delony L. Langer-Anderson, St. Paul, MN (US); Cristin E. Moran, St. Paul, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 127 days.

(21) Appl. No.: 13/996,442

(22) PCT Filed: Dec. 19, 2011

(86) PCT No.: PCT/US2011/065747

§ 371 (c)(1),
(2), (4) Date: Jun. 20, 2013

(87) PCT Pub. No.: WO2012/087885

PCT Pub. Date: Jun. 28, 2012

(65) Prior Publication Data

US 2013/0294056 A1 Nov. 7, 2013

Related U.S. Application Data

(60) Provisional application No. 61/426,587, filed on Dec. 23, 2010.

(51) Int. Cl.

| | |
|---|---|
| ***F21L 4/02*** | (2006.01) |
| ***F21L 4/00*** | (2006.01) |
| ***F21S 4/00*** | (2006.01) |
| ***F21V 21/08*** | (2006.01) |
| ***F21V 23/04*** | (2006.01) |
| *F21V 21/088* | (2006.01) |
| *F21V 21/002* | (2006.01) |
| *F21Y 101/02* | (2006.01) |
| *F21V 29/00* | (2015.01) |

(52) U.S. Cl.

CPC ... *F21L 4/02* (2013.01); *F21L 4/00* (2013.01); *F21S 4/001* (2013.01); *F21V 21/088* (2013.01); *F21V 21/0808* (2013.01); *F21V 23/04* (2013.01); *F21V 21/002* (2013.01); *F21V 21/0885* (2013.01); *F21V 29/20* (2013.01); *F21Y 2101/02* (2013.01)

(58) Field of Classification Search

CPC ..... F21V 21/0885
USPC ..... 362/100–104, 184
See application file for complete search history.

(56) References Cited

U.S. PATENT DOCUMENTS

| | | | | |
|---|---|---|---|---|
| 4,145,648 | A * | 3/1979 | Zender | 320/105 |
| 4,785,642 | A * | 11/1988 | Chin et al. | 63/1.13 |
| 5,018,053 | A * | 5/1991 | Belknap et al. | 362/104 |
| 5,140,840 | A * | 8/1992 | Miceli | 63/12 |
| 5,375,044 | A | 12/1994 | Guritz | |
| 5,434,759 | A | 7/1995 | Endo | |
| 5,455,749 | A | 10/1995 | Ferber | |
| 5,515,248 | A * | 5/1996 | Canfield et al. | 362/116 |

(Continued)

OTHER PUBLICATIONS

International Search Report for PCT International Application No. PCT/US2011/065747, Mailed Sep. 14, 2012, 3 pages.

*Primary Examiner* — Mary Ellen Bowman
(74) *Attorney, Agent, or Firm* — David B. Patchett

(57) ABSTRACT

An LED clip light assembly includes a battery, an electrically conductive clip member operatively associated with the battery, and at least one LED connected with the clip member.

19 Claims, 4 Drawing Sheets

(56) References Cited

U.S. PATENT DOCUMENTS

| | | | | |
|---|---|---|---|---|
| 5,559,681 | A | 9/1996 | Duarte | |
| 5,566,384 | A | 10/1996 | Chien | |
| 5,951,141 | A | 9/1999 | Bradley | |
| 6,056,415 | A * | 5/2000 | Allred et al. | 362/202 |
| 6,420,008 | B1 | 7/2002 | Lewis | |
| 6,568,828 | B2 | 5/2003 | Rudoy | |
| 6,957,898 | B2 | 10/2005 | Yu | |
| 6,966,668 | B2 | 11/2005 | Cugini | |
| 6,981,777 | B2 | 1/2006 | Barnes | |
| 7,065,910 | B2 | 6/2006 | Woodruff | |
| 7,465,078 | B2 | 12/2008 | Chang | |
| 7,551,957 | B2 | 6/2009 | Whelan | |
| 7,652,188 | B2 | 1/2010 | Levanon | |
| 7,752,790 | B1 | 7/2010 | Michael | |
| 8,002,427 | B2 * | 8/2011 | Lavigne | 362/153.1 |
| 2002/0159250 | A1 | 10/2002 | Kuo | |
| 2004/0120142 | A1 * | 6/2004 | Galli | 362/191 |
| 2005/0099799 | A1 | 5/2005 | Cugini | |
| 2007/0208395 | A1 | 9/2007 | Leclerc | |
| 2008/0058907 | A1 | 3/2008 | Reuben | |
| 2008/0137326 | A1 | 6/2008 | Levine | |
| 2009/0209896 | A1 | 8/2009 | Selevan | |
| 2009/0216299 | A1 | 8/2009 | Dantus | |
| 2010/0177504 | A1 | 7/2010 | Lau | |
| 2010/0221585 | A1 | 9/2010 | Terashima | |

* cited by examiner

CLIP LIGHT

BACKGROUND

The present invention relates generally to lighting devices and, more particularly, to compact lighting devices.

A wide variety of lighting devices, including lighting devices that can be affixed to a surface, are known in the prior art. U.S. Pat. No. 6,420,008 (Lewis et. al.) for example, discloses a display sticker with integral LED flasher circuit and power source adapted to be adhesively affixed to and readily removed from a fabric article.

U.S. Pat. No. 5,559,681 (Duarte) discloses a flexible, self-adhesive, lighting system including a continuous length of flexible, self-adhesive, light emissive material, cuttable into segments of light emissive material, each segment including a plurality of light emitting diodes serving as light emissive devices.

U.S. Pat. No. 6,981,777 (Barnes) discloses an emergency running light for vehicles such as watercraft including a cup-shaped housing made of a transparent, thin flexible wall which defines a cup-shaped interior chamber. A liquid component of a two-component chemiluminescent compound and a breakable capsule containing a second component thereof are disposed within the interior chamber. The housing is attachable to a surface of the watercraft following activation using an adhesive ring which engages a flat rim of the housing.

SUMMARY

The need exists for a small, lightweight, portable, durable, reusable, versatile, lighting device with a long life. The need also exists for such a device that can be attached to a variety of surfaces including directly to human skin. It would therefore be desirable to provide a compact, lightweight, portable, durable, reusable, versatile light that can be attached to a variety of surfaces including being attached directly to human skin.

The present invention provides an LED clip light assembly including a power source such as a battery, an electrically conductive clip member operatively associated with the battery, and at least one LED connected with the clip member.

The battery may be, for example, a 3 volt lithium coin cell (or button) battery. In one embodiment, the battery may be a 2032 size battery having a diameter of about 20 mm and a thickness of about 3.2 mm, and the battery may include generally planar first and second opposed major surfaces.

In more specific aspects, the clip member may comprise a bent strip of electrically conductive metal having opposed first and second major surfaces, and the electrically conductive metal may comprise spring steel.

The clip member may include a first leg portion, an intermediate portion extending from an end of the first leg portion, and a second leg portion extending from the intermediate portion in overlapping relation with the first leg portion, thereby forming a clamping region between the first leg portion and the second leg portion, wherein tension biases the first leg portion and second leg portion toward each other. The battery may be arranged in the clamping region between the first leg portion and the second leg portion.

In a specific embodiment, the intermediate portion may be arranged generally perpendicular to the first leg portion, and the intermediate portion may form an acute angle with the second leg portion. In another specific embodiment, the first leg portion may comprise a base portion. The base portion may have a length of at least 125% of the diameter of the battery, and the base portion may have a width of at least 50% of the diameter of the battery, thereby leaving opposite sides of the battery exposed so that a user can grasp the clip light by grasping opposite sides of the battery.

In one aspect, the clip member may include a toe portion extending upwardly from the end of the first leg portion, whereby the toe portion may serve as a stop that limits the extent of travel between the first leg portion and the battery.

In one embodiment, the clip member may comprise a first electrically conductive element connected with the LED and arranged to make electrical contact with the first major surface of the battery, thereby forming an electrical connection with the first major surface of the battery, and may comprise a second electrically conductive element connected with the LED and arranged to make selective electrical contact with the second major surface of the battery, thereby forming selective electrical connection with the second major surface of the battery.

In other aspects, the LED may be electrically connected with the first and second electrically conductive elements of the clip member, and the LED may be arranged on the second major surface of the second leg portion of the clip member. In another embodiment, the clip light may comprise an electrically insulating outer barrier layer arranged on at least a portion of one of the first and second major surfaces of the battery.

In one embodiment, the clip member may be movably connected with the battery, and the LED may be activatable by moving the clip member and battery relative to each other, thereby to electrically connect and disconnect the LED from the battery.

In a specific embodiment, the electrically insulating outer barrier layer may be affixed to at least one of the first and second opposed major surfaces of the battery, and the clip member and battery may be movable with respect to each other between a first position wherein both the first and second electrically conducting portions of the clip member are in contact with the battery, and a second position wherein at least one of the first and second electrically conducting portions of the clip member are separated from the battery by the electrically insulating outer barrier layer.

In various aspects, the battery may be slidably connected with the clip member, the battery may be rotatably connected with the clip member, and the clip member may be affixed to the battery. In one embodiment, the clip light may include an electrically insulating switch member movably arranged between the clip member and the battery, thereby to selectively disconnect power to the LED. In other aspects, the switch member may be selectively arranged between the battery and the clip second leg portion, the switch member may be formed of a polymeric film, and the switch member may comprise an opening arranged to allow the electrically conductive second element to contact, and thereby form an electrical connection with, the second major surface of the battery.

In a specific embodiment, the switch member may be movable between a closed position wherein the electrically conductive second element is arranged in the opening of the switch member, thereby to form an electrical connection with the second major surface of the battery, and an open position wherein the switch member is arranged between the electrically conductive second element and the second major surface of the battery, thereby preventing the electrically conductive second element from making electrical contact with the second major surface of the battery.

In a specific aspect, the second electrically conductive element may comprise an electrically insulating layer that electrically isolates the second electrically conductive element from the first electrically conductive element, and comprise an electrically conducting layer connected with the LED and arranged to selectively contact the second major surface of the battery. The second electrically conductive element may comprise a flexible circuit affixed to the clip member. The flexible circuit may comprise an adhesive layer, an electrically insulating layer, and a conductive layer, and the conductive layer of the flexible circuit may be connected with a first terminal of the LED, and the first electrically conductive element of the clip member may be connected with a second terminal of the LED.

In another aspect, the clip light may comprise an attachment mechanism for attaching the clip light assembly to a surface. The attachment mechanism may comprise adhesive, and the adhesive may be at least one of a repositionable adhesive and a medical grade adhesive that can be used to adhere the clip light to skin. In other embodiments, the attachment mechanism may comprise a bandage comprising a first adhesive arranged to bond the bandage to at least one of the clip member and the battery, a backing layer, and a second adhesive arranged to bond the bandage to a surface. In yet other embodiments, the attachment means may be a mechanical fastener such as a clip, clamp, magnet, suction cup, hook and loop fastener, and the like.

The present invention also provides a clip light comprising an electrically conductive clip member, and at least one light source connected with the clip member. The clip light may further comprise a power source operatively associated with the clip member. In a specific embodiment, the power source may comprise a battery or a low voltage power source of less than about 12V.

The clip light may be used in a wide variety of end use applications including task illumination for hobbies (e.g. woodworking, scrapbooking, model building, and sewing), repair work (e.g. automotive, boat, electrical work, plumbing), recreation (e.g. reading in bed), or work (e.g. allowing nurses to check patients at night), for decorative lighting (e.g. holiday, party), for tagging or identifying items (e.g. important papers, pets, mail boxes, home address, or to spell out words), for safety (e.g. while running, bicycling, or walking the dog); and for outdoor lighting (camping, hiking). It may be conveniently included in first aid kits, emergency response kits, and/or in tool boxes.

An advantage of certain embodiments of the clip light is that it is compact, lightweight, portable, durable, reusable, versatile, and that it can be attached to a variety of surfaces including directly to human skin. In addition, the clip light has good heat sinking characteristics, and it may be designed such that the LED is under powered, (for example, using a 3.3 volt LED with a 3 volt battery), thereby resulting in longer LED life.

BRIEF DESCRIPTION OF THE DRAWINGS

The present invention will be further described with reference to the accompanying drawings, in which.

DETAILED DESCRIPTION

Figure 1:
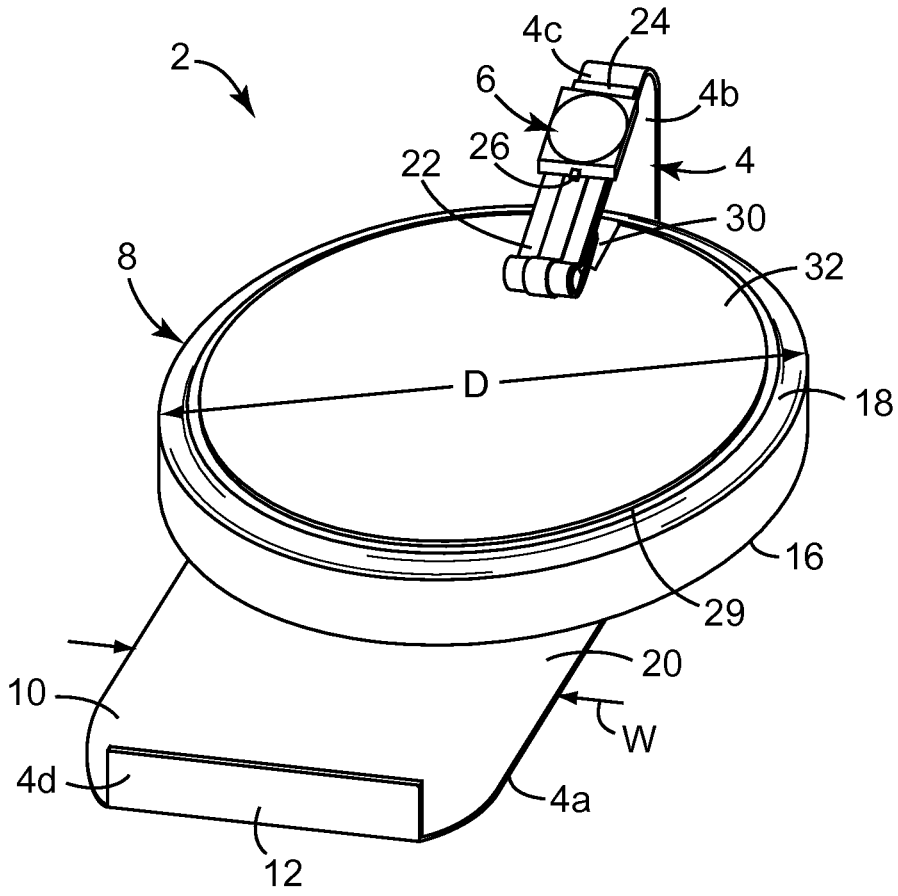
FIG. 1 is a perspective view of a battery operated clip light assembly according to the invention.
Figure 2:
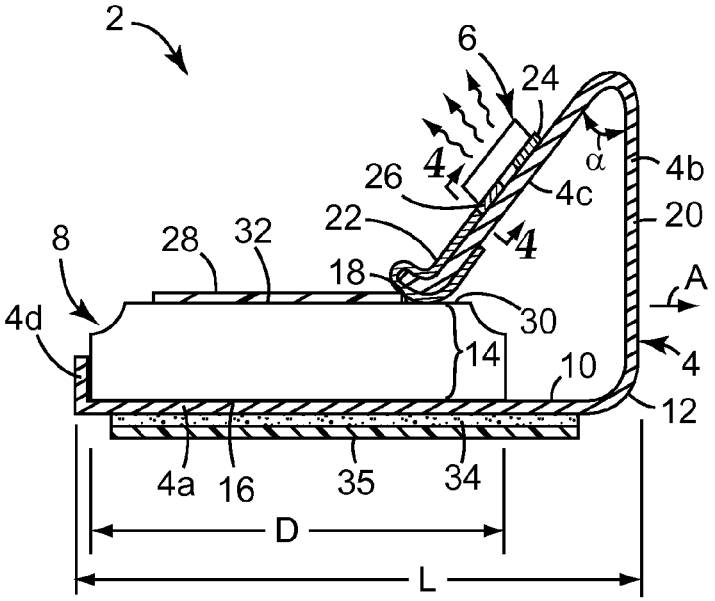
FIG. 2 is a diagrammatic cross-sectional view of the clip light assembly of FIG. 1 in its activated or "on" position.
Figure 3:
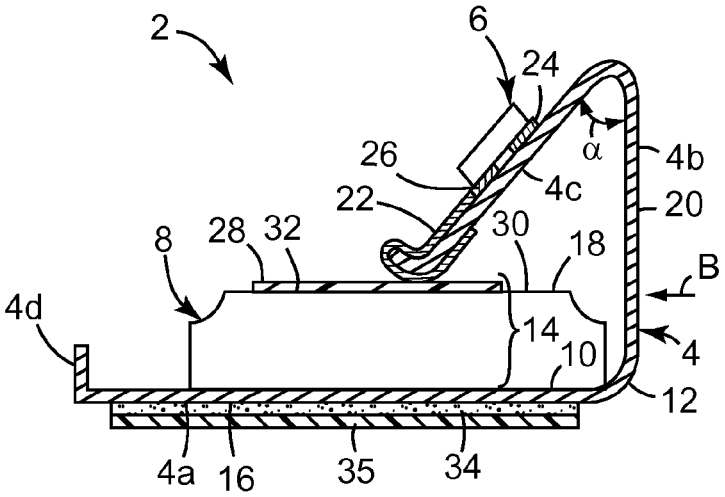
FIG. 3 is a diagrammatic cross-sectional view of the clip light assembly of FIG. 1 in its deactivated or "off" position.

Referring now to the drawings, FIGS. 1-3 show a clip light assembly 2 generally including an electrically conductive clip member 4, a light source 6 connected with the clip member 4, and an optional power source 8 connected with the electrically conductive clip member 4.

In the illustrated embodiment, the clip light assembly 2 includes a single light source 6. Clip light assemblies having more than one light source, however, are also considered within the purview of the invention. The number of light sources 6 can vary widely from, for example, a single light source as shown to an almost unlimited number depending on the type of light source, the type of power source, the size of the clip member, and the intended end use application for the clip light assembly 2.

Suitable light sources 6 include light emitting diodes (LED). The LED may be provided in any available color including, for example, red, orange, yellow, green, blue, and white. The light source 6 may optionally include reflectors, diffusers, lenses, filters, and/or polarizers to modify and/or direct the light. A suitable LED is a Nichia Chip Type white 3.3 volt LED (model no. NS3W183T-H1) available from Nichia Corporation, Detroit, Mich.

In one aspect, the LED light source 6 has an illuminance of 5-6 lux at a drive current of 8 milliamps when measured at a distance of 14 inches from the light source. At this level of luminous flex, the light source 6 provides an intensity of light that is sufficient to illuminate an object or surface (i.e. it provides enough light to allow a user to see the object) as opposed to an amount of light that simply allows the light source to be seen.

In the illustrated embodiment, the power source 8 is a battery. Suitable batteries include so called coin cell or button batteries. Such batteries are available in a variety of diameters and thicknesses, but are generally thin compared to their diameter. Such batteries have first and second opposed major surfaces that serve as the positive (+) and negative (−) terminals of the battery. A specific battery suitable for use with the clip light 2 is a Duracell DL2032 3V lithium coin cell battery. In a specific embodiment, a 3 volt battery is used with a 3.3 volt LED. In this situation, the LED is under powered, thereby increasing the life of the LED.

The clip member 4 includes a first leg portion 4*a*, an intermediate portion 4*b* extending from an end of the first leg portion 4*a*, and a second leg portion 4*c* extending from the intermediate portion 4*b* in overlapping relation with the first leg portion 4*a*. Arranged in this manner, the first leg portion 4*a* and second leg portion 4*c* form a clamping region 14 between the first leg portion 4*a* and the second leg portion 4*c*.

Tension biases the first leg portion 4*a* and second leg portion 4*c* toward each other when the first and second leg portions 4*a*, 4*c* are urged apart, and the battery 8 is arranged in the clamping region 14 between the first leg portion 4*a* and the terminal end of the second leg portion 4*c*. Installed in this manner, the battery 8 may be readily manually removed from clip member 4 during extended periods of non-use, and allows the battery to be replaced with a new battery, thereby allowing the clip light 2 to be reused. In the illustrated embodiment, the end of the second leg portion 4*c* that contacts the battery 8 is curved to form a ramp surface that allows the second leg portion 4*c* to slide smoothly along the top surface of the battery 8.

In the illustrated embodiment, the clip member 4 is formed of an electrically conductive material. Suitable electrically conductive materials include metals, such as steel, copper, and aluminum. In a specific embodiment, the clip member 4 and LED 6 are soldered together, and the clip member 4 is formed of a material that allows the solder to wet out onto the clip member 4. In this manner, a strong physical connection as well as a good electrical connection are formed between the clip member 4 and the LED 6. In one embodiment, the clip member 4 comprises a bent strip of spring steel having opposed first 10 and second 12 major surfaces. The battery 8 is arranged on the first major surface 10 of the first leg portion 4*a* of the clip member 4, and the LED 6 is arranged on the second major surface 10 of the second leg portion 4*c* of the clip member 4. In a specific embodiment, the LED 6 may be adjustably mounted on the clip member 4.

In the illustrated embodiment, the intermediate portion 4*b* of the clip member 4 is arranged generally perpendicular to the first leg portion 4*a*, and forms an acute angle a (FIG. 2) with the second leg portion 4*c*. The clip member 4 also includes an optional toe portion 4*d* that extends upwardly from the end of the first leg portion 4*a*. The toe portion 4*d* serves as a retaining portion or stop that limits the extent of travel between the first leg portion 4*a* and the battery 8.

In the illustrated embodiment, when the clip light 2 is mounted on a surface, the LED 6 will be thermally isolated from the surface. That is, the clip member 4 is constructed to space the LED 6 from the mounting surface, and the clip member 4 and battery 8 serve as heat sinks that conduct heat away from the LED. Thus, heat generated by the LED 6 will be dissipated by the clip member 4 and the battery 8, thereby keeping the LED cool and minimizing the amount of heat transferred to the mounting surface. This, in turn, serves to increase the life of the LED, and allows the clip light 2 to be mounted on heat sensitive surfaces, such as directly on the skin of an end user.

As alluded to above, the battery 8 includes generally planar first 16 and second 18 opposed major surfaces that define the positive (+) and negative (−) terminals of the battery, respectively. The clip member 4 includes first 20 and second 22 electrically conductive elements that connect with the positive 16 and negative 18 terminals of the battery, respectively. The first and second electrically conductive elements 20, 22 are connected with each other but are electrically insulated from each other.

The first electrically conductive element 20 of the clip member 4 comprises the first leg portion 4*a*, the intermediate portion 4*b*, and the second leg portion 4*c*. The first electrically conductive element 20 is connected with the positive 16 terminal of the battery 8 and with a first terminal/anode 24 of the LED 6.

The second electrically conductive element 22 is generally arranged at the terminal end of the second leg portion 4*c*. More specifically, the second electrically conductive element 22 is connected with a second terminal/cathode 26 of the LED, and extends from the LED 6 along the first major surface of the second leg portion 4*c* to the terminal end of the second leg portion 4*c*, wraps around the terminal end of the second leg portion 4*c*, and extends along a portion of the opposite surface of the second leg portion 4*c* such that when a battery 8 is installed in the clip light 2, the second electrically conductive element 22 contacts the negative terminal 18 of the battery 8 rather than the second leg portion 4*c*.

In the illustrated embodiment, the first electrically conductive element 20 is connected with the first terminal/anode 24 of the LED 6, and is arranged to remain in continuous sliding contact with the first major surface 16 of the battery 8. The second electrically conductive element 22 is connected with the second terminal/cathode 26 of the LED 6 and is arranged to make selective electrical contact with the second major surface/negative terminal 18 of the battery 8, thereby forming an electrical connection with the second major surface 18 of the battery 8. That is, the first and second terminals 24, 26 of the LED 6 are electrically connected with the first and second electrically conductive elements 20, 22, respectively, of the clip member 4, and the first and second electrically conductive elements 20, 22 are, in turn, connected with the positive and negative terminals 16, 18, respectively, of the battery 8.

In the embodiment illustrated in FIGS. 1-3, the clip member 4 is movably connected with the battery 8, and the LED 6 may be activated (i.e. turned on) by moving the clip member 4 and battery 8 relative to each other, thereby to electrically connect and disconnect the clip member 4, and hence the LED 6, from the battery 8. To accomplish this, the clip light 2 includes an electrically insulating outer barrier layer 28 arranged on the second major surface 18 of the battery 8, whereby the second major surface 18 of the battery 8 includes an exposed contact region 30 and a covered/electrically insulated region 32. In the embodiment shown in FIGS. 1-3, the outer barrier layer 28 is bonded or affixed to the second major surface 18 of the battery, and therefore does not move with respect to the battery during the operation of the clip light 2.

As shown in FIGS. 2 and 3, the clip member 4 and the battery 8 are movable with respect to each other between a first "on" position (FIG. 2) wherein both the first and second electrically conducting elements 20, 22 of the clip member 4 are in direct electrical contact with the battery 8, and a second "off" position (FIG. 3) wherein the second electrically conducting element 22 of the clip member 4 is separated from the battery 8 by the electrically insulating outer barrier layer 28. That is, in FIG. 2, the clip member 4 has been slid in the direction of arrow "A" such that the second electrically conducting element 22 of the clip member 4 is in contact with the exposed region 30 of the second major surface 18 of the battery 8, thereby forming an electrical connection that allows the LED 6 to be powered.

In FIG. 3, the clip member 4 has been slid in the direction of arrow "B" such that the second electrically conducting element 22 of the clip member 4 is in contact with the covered region 32 of the battery 8. In this position, the second electrically conducting element 22 of the clip member 4 is disconnected from the battery 8, and power from the battery to the LED 6 is shut off, thereby turning off the LED. To turn on the LED, the clip member 4 is simply moved in the direction of arrow "A" to reestablish electrical contact between the second electrically conducting element 22 of the clip member 4 and the exposed region 30 of the battery 8.

It will be understood that the barrier layer 32 may also be provided on the first major surface 16 of the battery 8 to selectively disconnect the first element 20 of the clip member 4 from the positive terminal 16 of the battery 8. For example, a barrier layer that covers all of the first major surface 16 of the battery 8 except a region that allows the first leg 4*a* of the first element 20 of the clip member 4 to contact the first major surface 16 of the battery 8 may be provided on the first major surface 16 of the battery 8. In this manner, to electrically disconnect the first element 20 of the clip member 4 from and the positive terminal 16 of the battery 8, the first element 20 of the clip member 4 is simply moved from the uncovered region of the battery 8 to the region covered by the barrier layer.

Figure 4:
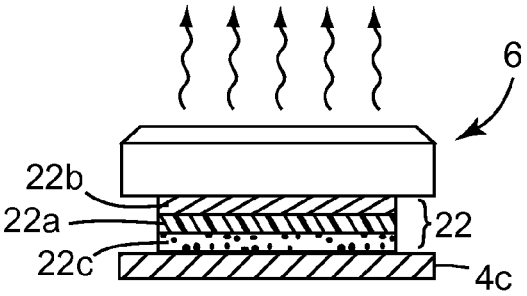
FIG. 4 is a detailed cross-sectional view taken along line 4-4 of FIG. 2.

Referring to FIG. 4, the second electrically conducting element 22 includes an electrically insulating layer 22*a*, which serves to electrically isolate the second electrically conductive element 22 from the first electrically conductive portion 20 of the clip member 4, and an electrically conducting layer 22*b* that is connected with the LED 6 and arranged to selectively contact the second major surface 18 of the battery 8 as described above, and an adhesive 22*c* for adhesively bonding the second electrically conducting element 22 to the second leg portion 4*c* of the clip member 4.

In one embodiment, the second electrically conductive element 22 comprises a flexible circuit. Suitable flexible circuits comprise an adhesive layer to bond the flexible circuit to the clip member 4, an electrically insulating layer, and an electrically conductive layer. The conductive layer of the flexible circuit is connected with a second terminal 26 of the LED 6, and the first electrically conductive element 20 of the clip member 4 is connected with a first terminal 24 of the LED 6, thereby to power the LED. Suitable flexible circuits are available from, for example, 3M Company, St. Paul, MN.

In the illustrated embodiment, the clip light 2 optionally includes an attachment mechanism 34 on the second major surface 12 of the clip member 4 to allow the clip light 2 to be secured to a surface. In the illustrated embodiment, the attachment mechanism 34 is an adhesive which is covered by a release liner 35. Suitable adhesives include permanent adhesives, repositionable adhesives, and medical grade adhesives that can be used to adhere the clip light 2 to skin. Alternatively, the adhesive 34 may be provided in the form of a bandage or a double sided tape. A suitable bandage may include, for example, a first adhesive arranged to bond the bandage to the clip member, a backing layer, and a second adhesive arranged to bond the bandage to a surface. Other suitable attachment mechanisms include, for example, mechanical fasteners such as clips, clamps, magnets, suction cups, hook-and-loop fasteners, and the like, and other conventional fasteners.

In the illustrated embodiment, the attachment mechanism 34 is provided on the second major surface 12 of the first leg portion 4*a* of the clip member 4. Alternatively, the attachment mechanism 34 may be provided on the first major surface 16 of the battery 8 in addition to, or in lieu of, the attachment mechanism 34 provided on the clip member, so long as the attachment mechanism 34 does not interfere with the ability of the first leg portion 4*a* of the clip member 4 to form an electrical connection with the battery 8, and allows for relative movement between the clip member 4 and battery 8 for on/off control of the light clip device 2.

In a specific aspect, the first leg portion 4*a* comprises a wide base portion. The base portion has a length "L" that is at least 125% of the diameter "D" of the battery 8, and the base portion has a width "W" that is at least 60%, 75%, or 90% of the diameter of the battery. In this manner, the base portion 4*a* overlaps a significant majority of the first major surface 16 of the battery 8, but leaves sufficient area on opposite sides of the battery 8 exposed so that a user can readily grasp both the clip member 4 and opposite sides of the battery 8, thereby allowing the user to move the clip member 4 and battery 8 relative to each other to turn the clip light 2 on and off. In addition, a base portion that substantially covers the first major surface 16 of the battery 8 provides a larger surface for the attachment mechanism 34.

Figure 5:
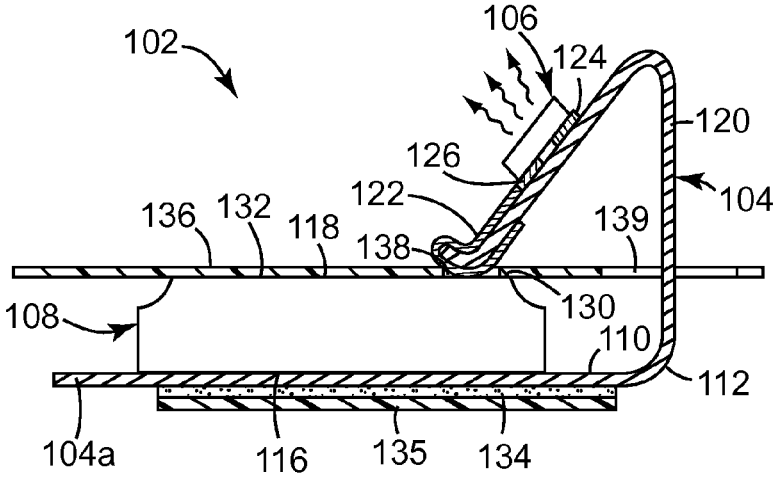
FIG. 5 is a diagrammatic cross-sectional view of a second embodiment of the invention shown in its activated or "on" position.
Figure 6A:
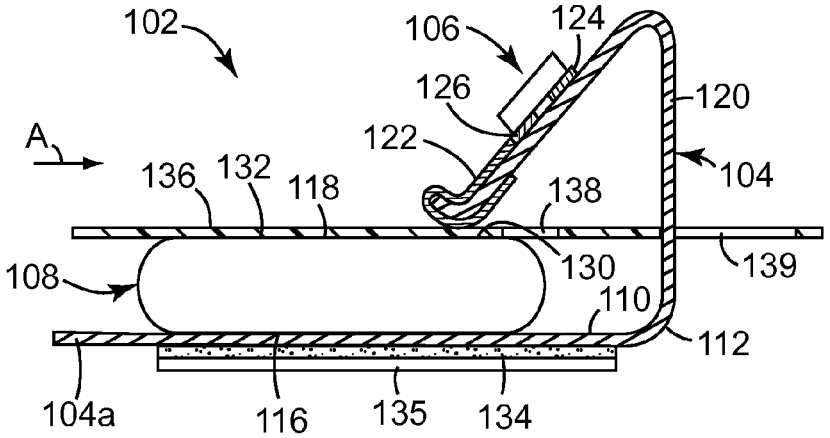
FIG. 6A is a diagrammatic cross-sectional view of the second embodiment of the invention shown in a first deactivated or "off" position.
Figure 6B:
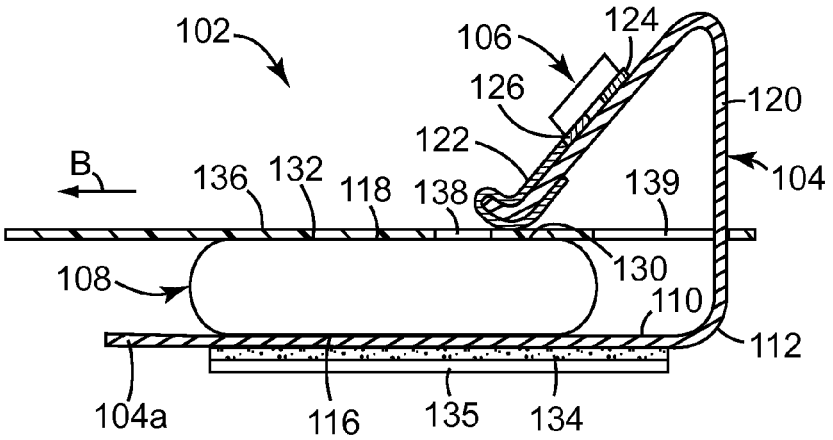
FIG. 6B is a diagrammatic cross-sectional view of the second embodiment of the invention shown in a second deactivated or "off" position.

Referring now to FIGS. 5, 6A and 6B, wherein functionally similar features to those in FIGS. 1-3 are referred to with like reference numerals incremented by 100, there is shown a clip light 102 including a clip member 104, a light source 106 in the form of an LED arranged on the clip member 104, a power source 108 in the form of a battery connected with the clip member 104, and an electrically insulating switch member 136 movably arranged between the clip member 104 and the battery 108, thereby to selectively interrupt power to the LED 106. The light clip 102 further includes an optional attachment means 134 and release liner 135, similar to the attachment mechanism 34 and release liner 35 described above in reference to the embodiment of FIGS. 1-3.

The switch member 136 contains an opening 138 arranged to allow the second electrically conducting element 122 of the clip member 104 to contact, and thereby form an electrical connection with, the second major surface 118 of the battery 108. In one aspect of the embodiment shown in FIGS. 5, 6A and 6B, the battery 108 may be secured, or permanently attached to, the first leg 104*a* of the clip member 104, whereby the battery 108 remains in a fixed position relative to the clip member 104 during the operation of the clip light 102.

More specifically, the switch member 136 is movable between an "on" position (FIG. 5) wherein both the first and second electrically conducting elements 120, 122 of the clip member 104 are in direct electrical contact with the battery 108, a first "off" position (FIG. 6A) wherein the switch member 136 is urged in the direction of arrow "A", such that the second electrically conducting element 122 of the clip member 104 is separated from the battery 108 by the electrically insulating switch member 136, and a second "off" position (FIG. 6B), wherein the switch member 136 is urged in the direction of arrow "B", such that the second electrically conducting element 122 of the clip member 104 is separated from the battery 108 by the electrically insulating switch member 136.

More particularly, in FIG. 5, the switch member 136 is arranged such that the second electrically conducting element 122 of the clip member 4 is arranged in the opening 138, thereby to contact the second major surface 118 of the battery 108, and forming an electrical connection that allows the LED 106 to be powered.

In FIG. 6A, the switch member 136 has been manually urged (i.e. slid) by an end user in the direction of arrow "A" such that the switch member 136 is arranged between the second electrically conducting element 122 of the clip member 104 and the battery 108, thereby preventing the second electrically conducting element 122 of the clip member 104 from making electrical contact with the second major surface 118 of the battery 108. In this position, the second electrically conducting element 122 of the clip member 104 is disconnected from the battery 108, and power from the battery 108 to the LED 106 is shut off, thereby turning off the LED 106.

To turn the LED 106 on again, the switch member 136 is simply moved back the position shown in FIG. 5 to reestablish electrical contact between the second electrically conducting element 122 of the clip member 104 and second major surface of the battery 108 via the opening 138.

As shown in FIG. 6B, the LED may also be turned off by sliding the switch member 136 in the direction of arrow "B" (i.e. opposite from the direction of arrow "A") such that the switch member 136 is again arranged between the second electrically conducting element 122 of the clip member 104 and the battery 108 and preventing the second electrically conducting element 122 of the clip member 104 from making electrical contact with the second major surface 118 of the battery 108. Thus, in this position, the second electrically conducting element 122 of the clip member 104 is disconnected from the battery 108, and power from the battery 108 to the LED 106 is shut off, thereby turning off the LED 106.

In the illustrated embodiment, the switch member 136 contains a slot 139. The first element 120 of the clip member 104 extends through the slot 139, and an end portion of switch member 136 extends beyond the first element 120 of the clip member 104. In this manner, the slot 139 allows the switch member 136 to be moved between the on and off positions, but secures the switch member 136 to the clip member 104 so that the switch member 136 cannot be readily separated from the clip member 104. Alternatively, the switch member 136 can be shortened to allow the switch member to be moved between the on and off positions shown in FIG. 5 and FIGS. 6A and 6B without abutting the first element 120 of the clip member 104, thereby eliminating the need for a slot.

The particular construction of the electrically insulating switch member 136 is not significant to the invention hereof, so long as it provides the described function, namely, it serves to interrupt the electrical connection between the second electrically conducting element 122 of the clip member 104 and second major surface 118 of the battery 108. In the illustrated embodiment, the electrically insulating switch member 136 is a thin stiff sheet of electrically insulating material. Suitable materials include, for example, ceramic materials, rubber, polymeric and synthetic plastic materials, such as polyethylene and polypropylene, and wood/paper materials.

An advantage of the embodiment of FIGS. 5-6 over the embodiment of FIGS. 1-3 is that the embodiment of FIGS. 5-6 allows conventional coin cell batteries to be used with the clip light 102. That is, with the embodiment of FIGS. 1-3, the battery 8 includes an insulating barrier layer 28 affixed to the battery 8. The insulating barrier layer 28 must be added to a conventional battery. In the embodiment of FIGS. 5-6, the insulating barrier layer 28 is eliminated, and the switch member 136 is used to turn the clip light on and off. Because the insulating barrier layer 28 is eliminated, a conventional battery 8 can be used, and because the switch member 136 is not affixed to the battery 8, the switch member 136 can be reused when the battery 8 is replaced.

Figure 7:
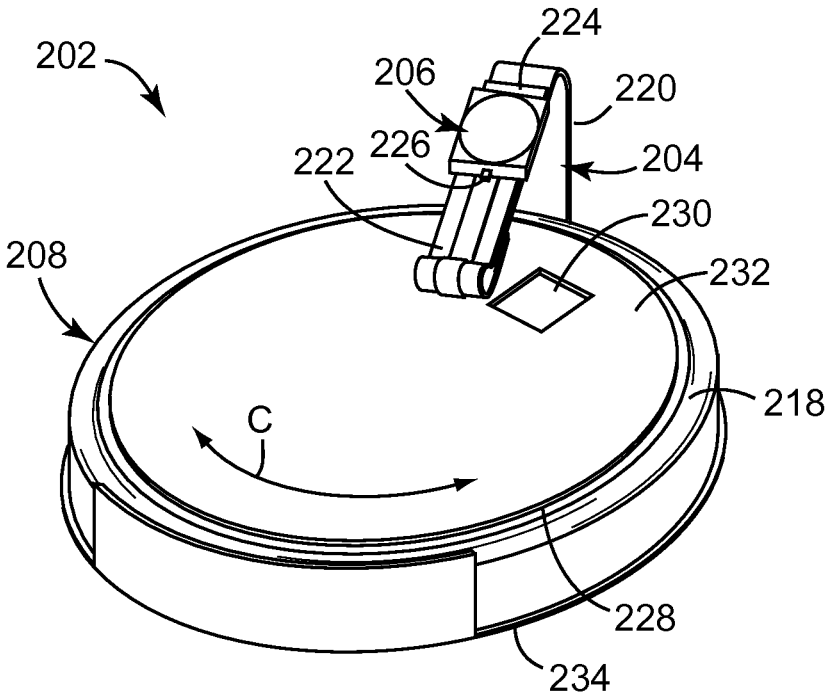
FIG. 7 is a perspective view of a third embodiment of the invention.

Referring now to FIG. 7, wherein functionally similar features to those in FIGS. 1-3 are referred to with like reference numerals incremented by 200, there is shown a clip light assembly 202 including a clip member 204, a light source 206 in the form of an LED arranged on the clip member 204, a power source 208 in the form of a battery connected with the clip member 204, an electrically insulating outer barrier layer 228 arranged on the second major surface 218 of the battery 208, and an optional attachment mechanism 234.

The clip light assembly 202 shown in FIG. 7 is similar to the clip light assembly 2 shown in FIGS. 1-3 except the clip light assembly 202 is configured to be turned on and off by rotating the slip member 204 and battery 208 relative to each other, rather than moving them translationally as described above in reference to the embodiment shown in FIGS. 1-3. The electrically insulating outer barrier layer 228 is arranged on the second major surface 218 of the battery 208, whereby the second major surface 218 of the battery 208 includes an exposed region 230 and a covered region 232. The outer barrier layer 228 is affixed to the second major surface 218 of the battery 208, and therefore does not move with respect to the battery 208 when the battery 208 is rotated with respect to the clip member 204.

When the clip member 204 and the battery 208 are rotated with respect to each other as shown by arrow "C", the clip member 204 and battery 208 will rotate between an "on" position wherein both the first and second electrically conducting elements 220, 222 of the clip member 204 will be in direct electrical contact with the battery 208, and an "off" position wherein the second electrically conducting element 222 of the clip member 204 will be separated from the battery 208 by the electrically insulating outer barrier layer 228. When in the "on" position, the second electrically conducting element 222 of the clip member 204 will contact the second major surface 218 of the battery 208 via the exposed region 230, thereby forming an electrical connection with the battery 208 that allows the LED 206 to be powered.

Figure 8:
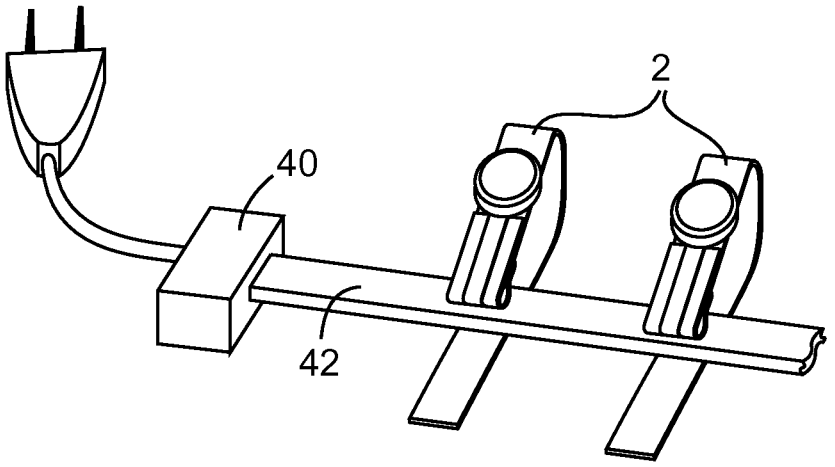
FIG. 8 is a perspective view of a lighting system including a plurality of clip lights.

Referring now to FIG. 8, there is shown an embodiment of the invention wherein the power source is a low voltage DC power source 40, rather than a battery, and a plurality of clip lights 2 are attached to an electrical wire or cable 42. It will be recognized that the clip light 2 may be provided in the form of any of the embodiments described herein, and that an almost unlimited number of clip lights 2 may be provided on the electrical wire 42. Suitable low voltage CD power supplies include, for example, conventional 12 volt low voltage power supplies.

In a specific embodiment, the clip light 2 may be provided in the form of a kit. The kit may include, for example, different types of light sources (e.g. different sizes or colors of LEDs), replacement lights, attachments such as reflectors, diffusers, lenses, filters, and/or polarizers for altering or modifying the light, replacement batteries, and/or different types of attachment mechanisms such as clips, clamps, magnets, suction cups, hook-and-loop fasteners and/or bandages.

Persons of ordinary skill in the art may appreciate that various changes and modifications may be made to the invention described above without deviating from the inventive concept. For example, the clip light 2 may be equipped with conventional switches to connect and disconnect the light source 6 from the power source 8. Thus, the scope of the present invention should not be limited to the structures described in this application, but only by the structures described by the language of the claims and the equivalents of those structures.

What is claimed is:

1. An LED clip light assembly, comprising:

(a) a battery;

(b) an electrically conductive clip member operatively associated with the battery; and (c) at least one LED connected with the clip member;

wherein the clip member includes a bent strip of electrically conductive metal defining opposing, first and second major surfaces, the bent strip including a first leg portion and a second leg portion, the first leg portion extending in an overlapping relation with the second leg portion;

and further wherein the battery is arranged on the first major surface between the first and second, leg portions, and the at least one LED is arranged on the second leg portion.

2. A clip light assembly as defined in claim 1, wherein the clip member further includes an intermediate portion extending between the first leg portion and the second leg portion, wherein a clamping region is formed between the first leg portion and the second leg portion, and further wherein tension biases the first leg portion and the second leg portion toward each other.

3. A clip light assembly as defined in claim 2, wherein the battery is arranged in the clamping region between the first leg portion and the second leg portion.

4. A clip light assembly as defined in claim 1, wherein the battery includes generally planar first and second opposed major surfaces.

5. A clip light assembly as defined in claim 1, wherein the clip member comprises a first electrically conductive element connected with the LED and arranged to make electrical contact with a first major surface of the battery, thereby forming an electrical connection with the first major surface of the battery, and a second electrically conductive element connected with the LED and arranged to make selective electrical contact with a second major surface of the battery, thereby forming selective electrical contact with the second major surface of the battery.

6. A clip light assembly as defined in claim 5, further comprising an electrically insulating outer barrier layer arranged on at least a portion of one of the first and second major surfaces of the battery.

7. A clip light assembly as defined in claim 6, wherein the clip member is movably connected with the battery, and further wherein the LED is activatable by moving the clip member and battery relative to each other, thereby to electrically connect and disconnect the LED from the battery.

8. A clip light assembly as defined in claim 7, wherein the electrically insulating outer barrier layer is affixed to at least one of the first and second opposed major surfaces of the battery, and further wherein the clip member and battery are movable with respect to each other between a first position wherein both the first and second electrically conducting portions of the clip member are in contact with the battery, and a second position wherein at least one of the first and second electrically conducting portions of the clip member are separated from the battery by the electrically insulating outer barrier layer.

9. A clip light assembly as defined in claim 1, wherein the battery is slidably connected with the clip member.

10. A clip light assembly as defined in claim 1, wherein the battery is rotatably connected with the clip member.

11. A clip light assembly as defined in claim 1, wherein the clip member is affixed to the battery.

12. A clip light assembly as defined in claim 1, further comprising an electrically insulating switch member movably arranged between the clip member and the battery, thereby to selectively disconnect power to the LED.

13. A clip light assembly as defined in claim 1, wherein the battery is a button cell battery.

14. A clip light assembly as defined in claim 1, wherein the clip member further includes first and second electrically conductive elements, wherein the second electrically conductive element comprises a flex circuit affixed to the bent strip, the flex circuit comprising an adhesive layer, an electrical insulating layer, and a conductive layer, and further wherein the conductive layer of the flex circuit is connected with a first terminal of the LED, and the first electrically conductive element of the clip member is connected with a second terminal of the LED.

15. A clip light assembly as defined in claim 1, further comprising an attachment mechanism for attaching the clip light assembly to a surface.

16. A clip light, comprising:

(a) an electrically conductive clip member forming a clamping region for securing a power source; and (b) at least one light source connected to the clip member;

wherein the clip member directly electrically connects the light source to the clamping region.

17. A clip light as defined in claim 16, further comprising a power source operatively associated with the clip member.

18. A clip light as defined in claim 17, wherein power source comprises a battery or a low voltage power source of less than about 12V.

19. A clip light as defined in claim 18, wherein the light source is a light emitting diode.

* * * * *